US006213832B1

(12) United States Patent
Fest, Sr.

(10) Patent No.: US 6,213,832 B1
(45) Date of Patent: Apr. 10, 2001

(54) PERSONAL FLOTATION DEVICE AND RELATED SYSTEM FOR MAINTAINING HUMAN BODY IN PARTIALLY-SUBMERGED HORIZONTAL POSITION

(76) Inventor: Otto P. Fest, Sr., 6807 E. Camino Bel Dorado, Tucson, AZ (US) 85715

( * ) Notice: Subject to any disclaimer, the term of this patent is extended or adjusted under 35 U.S.C. 154(b) by 0 days.

(21) Appl. No.: 09/350,706

(22) Filed: Jul. 9, 1999

Related U.S. Application Data

(60) Provisional application No. 60/100,551, filed on Sep. 16, 1998.

(51) Int. Cl.[7] ..... B63C 9/08

(52) U.S. Cl. ..... 441/129; 441/80; 441/81; 441/88; 441/130; 441/131

(58) Field of Search ..... 441/88, 119, 129, 441/130, 131, 81, 40, 124, 80, 89

(56) References Cited

U.S. PATENT DOCUMENTS 1,184,325 * 5/1916 Coxey ..... 441/80
1,205,514 * 11/1916 Carroll .
1,566,858 * 12/1925 Guinzburg ..... 441/81
4,059,859 * 11/1977 Hull ..... 441/81
4,861,300 * 8/1989 Casagrande et al. ..... 441/81
4,976,642 * 12/1990 Wilkie ..... 441/81
5,324,221 * 6/1994 Kaufman et al. ..... 441/129
5,406,653 * 4/1995 Todor ..... 4/496
5,507,674 * 4/1996 Yeung ..... 441/131
5,685,753 * 11/1997 Canela et al. .

* cited by examiner

*Primary Examiner*—Stephen Avila
*Assistant Examiner*—Lars A. Olson
(74) *Attorney, Agent, or Firm*—McCormick, Paulding & Huber LLP

(57) ABSTRACT

A personal flotation device is configured and sized so that it is adapted to be positioned beneath a person's body to cause the person to be suspended in equilibrium in a partially-submerged state. The device includes a ring-shaped body and a plurality of side floats extending radially away from the ring-shaped body.

4 Claims, 2 Drawing Sheets

PERSONAL FLOTATION DEVICE AND RELATED SYSTEM FOR MAINTAINING HUMAN BODY IN PARTIALLY-SUBMERGED HORIZONTAL POSITION

PRIORITY DOCUMENTS

This application corresponds to and derives priority from U.S. Provisional Application Ser. No. 60/100,551, filed Sep. 16, 1998.

TECHNICAL FIELD

The present invention relates to personal flotation devices for use in water and, more particularly, to a personal flotation device designed to support a human body in a generally horizontal, equilibrium floating position in water while permitting a portion of the body to remain submerged.

BACKGROUND OF THE INVENTION

For a variety of purposes including recreation, medical therapy and survival, it is desirable to provide devices for assisting humans in personal flotation. Various known personal flotation devices exist, most typically in the form of a vest or jacket-type flotation device worn like a garment or a flotation ring.

The jacket-type flotation device is worn securely around the torso of the body and, generally, causes the body to float in a substantially vertical position, whereby the head is above the surface of the water and the feet and legs are extended downward. While this design has some advantages over others because it can be securely fastened to a body, and remain securely fastened, before and after entry into water, it limits flotation to the substantially vertical position and it necessarily covers around the body. In recreational or therapeutic situations, a horizontal floating position may be desired or required. Additionally, in survival or rescue situations, it may be desirable to maintain a person's body in a horizontal situation if, for example, the person is in shock or has been traumatized. To some extent, a person's body temperature can be maintained for a longer period of time in otherwise cold waters if the body horizontally and as close to the surface as possible. In certain situations, such as when one is sun-tanning or relaxing, or when one has been injured in the torso area, it may be undesirable to wear a wrap-around flotation jacket. For these and other reasons, a vest or jacket-type flotation device has shortcomings.

Conventional flotation rings, usually made of foam or inflatable plastic, are designed to be grasped and held by a person's hand or, in the case of a child's recreation device, worn around the torso and under the arms. In either context, the flotation ring requires the person using it to be floated in a semi-horizontal position. It is difficult to sit on such a flotation ring without, due to difficulty in balance, slipping off the ring to one side and having the ring come shooting up to the surface of the water. The exception is the use of an over-sized tire inner type in which a person can sit with his seat positioned in the center of the tube. In this situation, however, the person is elevated above the water and does not experience or obtain the benefit and enjoyment of submersion in the water. Nor does the person have the ability to stretch out or moved his arms and legs, while submerged, for comfort, exercise and therapy.

The least buoyant part of the human body is the lower half, since it generally contains more dense mass than the upper half. Thus, in order to support a human body in floating equilibrium, it is necessary to compensate for this buoyancy imbalance by providing buoyant lift to the lower half of the body. Certain devices, such as conventional inflatable rafts and floating chairs provide buoyant lift to the lower half of the body.

Conventional inflatable rafts or mattresses, while permitting a person to float horizontally, do not enable submersion into the water. Other known devices, such as floating garden chairs and the like are cumbersome and restrict movement. In addition, they typically require the upper part of the body to remain out of the water, thereby eliminating the cooling effect of the water on that part of the body.

OBJECTS AND SUMMARY OF THE INVENTION

It is an object of the present invention to provide a personal flotation device and system that overcomes the shortcomings discussed above. It is another object of the present invention to provide a personal flotation device and system that enables horizontal, stable and submerged flotation of a person's body. It is another object of the present invention to provide a personal flotation device that is inexpensive, simple and durable, easily carried and stored, and quickly and easily used. These objects and others are achieved by the invention described herein. The present invention involves a generally ring-shaped flotation body having one or more radially extending flotation arms configured to add stability and buoyancy to the ring portion. Preferably, the flotation body is flexible and lightweight, made of inflatable plastic or rubber. The flotation body is designed to be placed under a person's seat to support the lower half of the body so that the body will float generally horizontally. An optional, scaled-down version of the flotation body can be provided under the back of the head of a person floating horizontally on his back in order to ensure flotation of the head and positioning of the mouth and nostrils above the water line.

Alternative modes of use for the flotation body may be implemented for various desired flotation positions. For example, the flotation body may be positioned under the arms or the seat of the user for vertical-position flotation. It may also be positioned under the chest area of the user to allow the user to float generally horizontally in a face-down orientation, while maintaining the head above water and enabling free use of the arms and legs.

DESCRIPTION OF THE PREFERRED EMBODIMENTS

Figure 1:
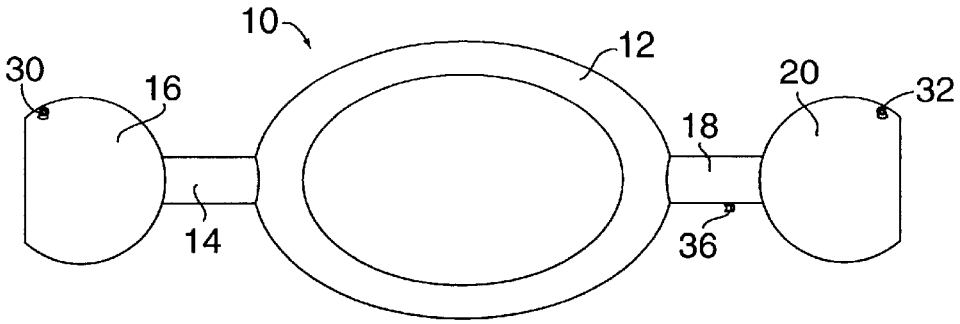
FIG. 1 is a top view of a first embodiment of the present invention.
Figure 2:
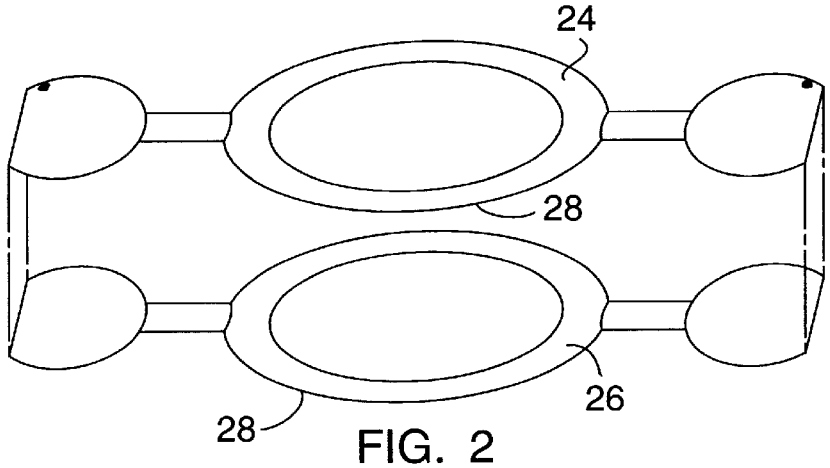
FIG. 2 is an exploded, side view of the embodiment illustrated in FIG. 1.

A first embodiment of the present invention is disclosed in FIGS. 1–5. Referring to FIG. 1, a personal flotation device

(10) comprises a main body ring (12), a first arm (14) and associated first side float (16), and a second arm (18) and associated second side float (20). The body ring (12) can be made of any one of a variety of buoyant materials such as Styrofoam or inflatable plastic, vinyl or rubber. In the preferred embodiment, the body ring (12) is made of inflatable plastic for optimum economy, storage and transport, softness and buoyancy. The arms (14, 18) and associated floats (16, 20) can be made of the same material as the body ring (12) and, preferably, are unitary with the body ring (12). In the preferred embodiment, referring to FIG. 2, two symmetric plastic material sheets (24, 26) are mated at the edges (28) by heating or gluing to form an air-tight seal all around. One inflation valve can be provided for the entire device, or the device may be sectioned off by sealing, in which case, for example, separate inflation valves (30, 32) can be provided to each of the side floats (16, 20) and one inflation valve (36) can be provided for the ring body (12) and arms (14, 18). By compartmentalizing separately inflatable sections, partial buoyancy can be maintained even if one or more separately sealed sections leak air or otherwise malfunction.

Figure 3:
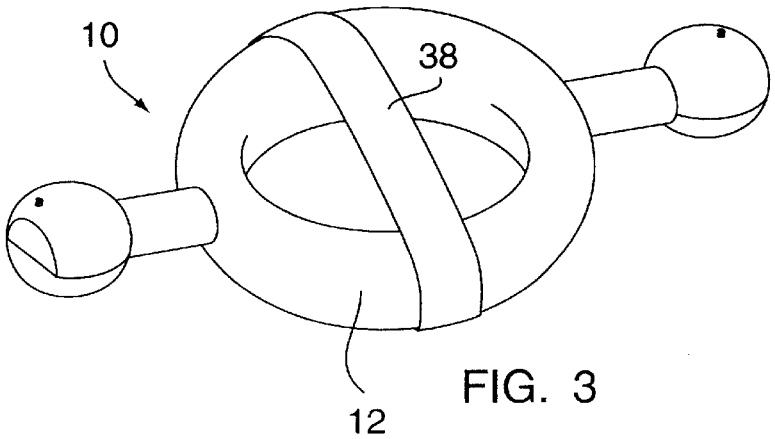
FIG. 3 is a partial, top view of an accessory according to the present invention being implemented with the embodiment illustrated in FIG. 1.

In operation, the device (10) is inflated to provide a desired level of buoyancy and comfort for a person using the device (10) to position his seat on the ring body (12) in a centered fashion and the float, by means of the device, in a body of water. The diameter of the ring body (12) is such that the person's seat is supported generally on top of the ring body (12), so that the person does not inadvertently fall through the opening in the center of the ring body (12). In the event that a person is too small to prevent falling through the ring body (12), a supplemental strap or cross-member (38), as shown in FIG. 3, can be provided as a detachable accessory. The cross-member (38) is attached to traverse the central opening of the ring body (12).

The arms (14, 18) and side floats (16, 20) are sized and configured to provide support, balance and stability so that a person sitting or laying with his seat on the ring body (12) will not easily tip or roll.

Figure 5:
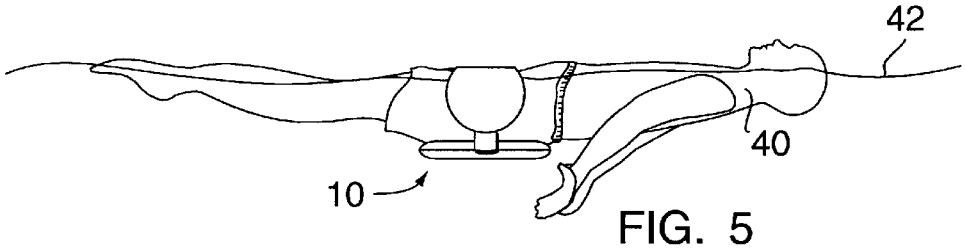
FIG. 5 a side view of the embodiment illustrated in FIG. 1 in use.
Figure 4:
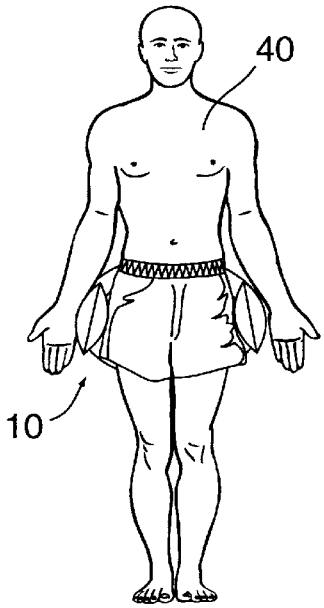
FIG. 4 is a top view of the embodiment illustrated in FIG. 1 in use.

Referring to FIGS. 4 and 5, the device (10), once positioned under the seat of the user (40), buoyantly lifts the legs and seat of the user (40) thereby enabling the user to lay back his head and shoulders and attain a floating equilibrium position. The arms (14, 18) will have a tendency to flex so that the side floats (16, 20) rise to the water surface (42) and cause the arms (14, 18) to support the sides of the user (40) so that tipping and rolling are prevented. The buoyancy of the device (10) is preferably such that the user's body (40) will remain substantially submerged below the water surface (42) in order to benefit from the cooling effects and floating sensation provided by the water.

Figure 8:
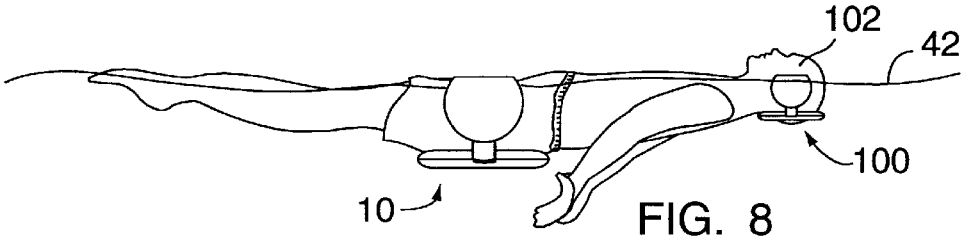
FIG. 8 is a side view of both first and second embodiments of the present invention in simultaneous use.
Figure 6:
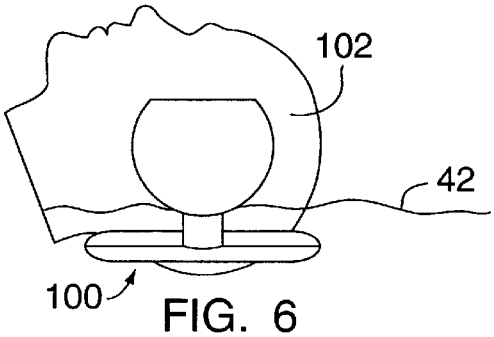
FIG. 6 is a side view of a second embodiment of the present invention in use.
Figure 7:
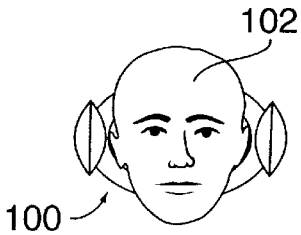
FIG. 7 is a top view of the second embodiment illustrated in FIG. 6.

In another aspect of the present invention, a smaller version of the device (10) is provided in the form of a head floating device (100) as shown in FIGS. 6 and 7. The user's head (102) rests on the device (100) while the user is laying back as shown in FIGS. 4 and 5. The device (100) provides support and flotation in a manner similar to that described with respect to the device (10) illustrated in FIGS. 1–5. It could be used to ensure prevention of inhalation or swallowing of water. The head floating device (100) and the device (10) described in FIGS. 1–5 can be used together, as shown in FIG. 8, to comprise a system of flotation devices. Alternatively, the device (10) described in FIGS. 1–5 can be placed under the chest and arms of a user laying generally face-down for use while floating or performing a swimming stroke. It may also be used together with a life jacket or other device as a supplement.

While the preferred embodiments have been herein described, it is understood that variation and modification may be made without departing from the scope of the presently claimed invention.

What is claimed is:

1. A personal flotation device, comprising:

a buoyant ring body having a central opening therethrough;

a plurality of arms each in physical communication with and extending generally radially outwardly from the ring body from a first end to a second end;

a plurality of buoyant side floats each in physical communication with an associated arm; and wherein said ring body, said side floats and said arms are made from two flat sheets of material joined to each other at their respective perimeters, thereby forming an air-tight unitary body adapted to be filled with air.

2. A personal flotation device for supporting a person in a generally horizontal, partially submerged state of floating equilibrium in a body of water, said device comprising:

a buoyant ring body having a central opening therethrough and being adapted to be positioned underneath the seat of the person at a position below the surface of the body of water;

a plurality of arms each in physical communication with and extending generally radially outwardly from the ring body from a first end to a second end;

a plurality of buoyant side floats each in physical communication with an associated arm and each adapted to float upward relative to the ring body along the sides of the person when said ring body is positioned beneath the seat of the person; and wherein said ring body, said side floats and said arms are made from two flat sheets of material joined to each other at their respective perimeters, thereby forming an air-tight unitary body adapted to be filled with air.

3. A personal flotation system for supporting a person in a generally horizontal, partially submerged state of floating equilibrium in a body of water, said system comprising:

a first buoyant ring body having a central opening therethrough and being adapted to be positioned underneath the seat of the person at a position below the surface of the body of water;

a plurality of first arms each in physical communication with and extending generally radially outwardly from the first ring body from a first end to a second end;

a plurality of first buoyant side floats each in physical communication with an associated first arm and each adapted to float upward relative to the first ring body along the sides of the person when said first ring body is positioned beneath the seat of the person;

a second buoyant ring body being of smaller diameter than said first buoyant ring body, and being adapted to be positioned underneath the head of the person at a position below the surface of the body of water;

a plurality of second arms each in physical communication with and extending generally radially outwardly from the second ring body from a first end to a second end;

a plurality of second buoyant side floats each in physical communication with an associated second arm and each adapted to float upward relative to the second ring body along the sides of the person when said second ring body is positioned beneath the seat of the person;

wherein said first ring body, said first arms and said first side floats are made from two flat sheets of material joined to each other at their respective perimeters, thereby forming an air-tight unitary body adapted to be filled with air; and said second ring body, said second side floats and said second arms are made from two flat sheets of material joined to each other at their respective perimeters, thereby forming an air-tight unitary body adapted to be filled with air.

4. A personal flotation device comprising:

a buoyant ring body having a central opening therethrough;

a plurality of arms each physically communicating with the ring body and extending generally radially outwardly from said ring body; and a plurality of buoyant side floats each physically communicating with an associated arm, the ring body, the side floats and the arms being made from two flat sheets of material joined to each other at their respective perimeters, thereby forming an air-tight unitary body adapted to be filled with air.

* * * * *